US011749472B1

(12) United States Patent
Ni

(10) Patent No.: US 11,749,472 B1
(45) Date of Patent: Sep. 5, 2023

(54) DUSTPROOF MICRO SWITCH

(71) Applicant: ZHEJIANG JIABEN ELECTRONICS CO., LTD., Yueqing (CN)

(72) Inventor: Shenglong Ni, Yueqing (CN)

(73) Assignee: ZHEJIANG JIABEN ELECTRONICS CO., LTD., Yueqing (CN)

( * ) Notice: Subject to any disclaimer, the term of this patent is extended or adjusted under 35 U.S.C. 154(b) by 0 days.

(21) Appl. No.: 17/893,558

(22) Filed: Aug. 23, 2022

(30) Foreign Application Priority Data

Feb. 25, 2022 (CN) ..... 202210176373.9

(51) Int. Cl.

| | |
|---|---|
| ***H01H 13/06*** | (2006.01) |
| ***H01H 13/36*** | (2006.01) |
| ***H01H 13/50*** | (2006.01) |
| ***H01H 13/14*** | (2006.01) |

(52) U.S. Cl.
CPC ..... *H01H 13/06* (2013.01); *H01H 13/14* (2013.01); *H01H 13/36* (2013.01); *H01H 13/50* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 13/06
See application file for complete search history.

(56) References Cited

U.S. PATENT DOCUMENTS

| | | | | |
|---|---|---|---|---|
| 5,459,295 A * | 10/1995 | Ohta | H01H 1/58 200/461 |
| 6,399,908 B1 * | 6/2002 | Mueller | H01H 5/18 200/332 |
| 10,453,630 B2 * | 10/2019 | Domzalski | H01H 13/26 |

* cited by examiner

*Primary Examiner* — Ahmed M Saeed
(74) *Attorney, Agent, or Firm* — Fox Rothschild LLP; Carol Thorstad-Forsyth

(57) ABSTRACT

A dustproof micro switch is provided by the present disclosure, comprising a base body, an upper cover, and a button, wherein the base body and the upper cover form a box body; the upper cover is provided with a first half of through hole for the button, the base body is provided with a second half of through hole for the button, and the first half of through hole for the button and the second half of through hole for the button form a through hole for the button; one end of the button is arranged in the box body, and the other end of the button extends out of the box body through the through hole for the button; the end, extending out of the box body, of the button is provided with a sealing sleeve, and the movable contact arm support is arranged on the base body.

18 Claims, 6 Drawing Sheets

DUSTPROOF MICRO SWITCH

CROSS-REFERENCES TO RELATED APPLICATION

This application is claims priority to Chinese Patent Application No. 202210176373.9, which was filed on Feb. 25, 2022 and entitled "DUSTPROOF MICRO SWITCH". The content of the priority application is hereby incorporated herein by reference in its entirety.

TECHNICAL FIELD

The present disclosure relates to a micro switch, and in particular relates to a dustproof micro switch.

BACKGROUND ART

At present, the micro switch on the market has the following functional defects:

1. Due to the fact that commonly used micro switch does not have a dustproof function, when used in the apparatus or electric garden tools with high protection requirements for the switch, the dust is easy to enter the switch to cause electrical short circuit or non-conduction, or even cause the switch to be burned. This micro switch does not comply with the Chinese safety standard of GB15092.1 and has significant safety risks for human life.

2. The commonly used micro switch is provided with a sealing ring around an internal button to achieve dust prevention, however, the poor assembly is easy to be caused due to small size, complex manufacturing process and high assembly difficulty of the sealing ring, resulting in high manufacturing cost and poor dustproof effect. In a case that the micro switch is used in the apparatus, electric tools or electric garden tools with high requirements for dust prevention, the dust is easy to enter the switch, or even cause the switch to be burned. This micro switch also does not comply with the Chinese safety standard of GB15092.1, and has significant safety risks for human life.

3. When the commonly used micro switch is used in the high-voltage DC apparatus, electric tool or electric garden tool over 42 V, the switch may generate huge electric arc in the turn-on and turn-off process, it is easy to cause adhesion of silver contacts, resulting in uninterrupted power supply of the high-voltage DC apparatus, the electric tools or the electric garden tools. This micro switch also does not comply with the Chinese safety standard of GB15092.1, and has significant safety risks for human life.

Therefore, it is imperative to design a dustproof micro switch.

SUMMARY

In accordance with a first aspect of an embodiment of the present disclosure, a dustproof micro switch is provided, which comprises a base body, an upper cover, and a button, wherein the base body and the upper cover forms a box body;

the upper cover is provided with a first half of through hole for the button, the base body is provided with a second half of through hole for the button, and the first half of through hole for the button and the second half of through hole for the button form a through hole for the button; one end of the button is arranged in the box body, and another end of the button extends out of the box body through the through hole for the button;

the end, extending out of the box body, of the button is provided with a sealing sleeve, a movable contact arm assembly and a movable contact arm support for fixing the movable contact arm assembly are arranged below one end of the button arranged in the box body, and the movable contact arm support is arranged on the base body; and a terminal assembly in fit with the movable contact arm assembly is further arranged in the box body.

In an embodiment, a cross section of the sealing sleeve is circular, and a diameter of the cross section of an end, close to the box body, of the sealing sleeve is larger than that of the cross section of an end, away from the box body, of the sealing sleeve;

the upper cover is provided with a first button boss at a position of the first half of through hole for the button, and the base body is provided with a second button boss at a position of the second half of through hole for the button; the first button boss is provided with a first button boss outer edge, and the second button boss is provided with a second button boss outer edge; a first button clamping groove is formed between the first button boss outer edge and the upper cover, a second button clamping groove is formed between the second button boss outer edge and the base body, and the first button clamping groove and the second button clamping groove form a button clamping groove; button clamping block is arranged on a periphery of a bottom of the sealing sleeve, and the bottom of the sealing sleeve is sleeved outside the button through the fitting of the button clamping blocks with the button clamping grooves;

a top of the sealing sleeve is provided with a snap-fitting hole, a top of the button is provided with a button outer edge, and the top of the sealing sleeve is sleeved outside the button through the fitting of the snap-fitting hole with the button outer edge.

In an embodiment, the movable contact arm assembly comprises a movable contact arm, a connecting plate, and a spring plate; one end of the connecting plate is arranged on a first connecting position of the movable contact arm support, another end of the connecting plate is connected to one end of the movable contact arm, and another end of the movable contact arm is suspended; one end of the spring plate is arranged on a second connecting position of the movable contact arm support, and another end of the spring plate is connected to the suspended end of the movable contact arm;

the terminal assembly comprises a normally open stationary contact pin and a normally closed stationary contact pin which are arranged on the base body, the normally open stationary contact pin is arranged below the movable contact arm, and the normally closed stationary contact pin is arranged above the movable contact arm;

the suspended end of the movable contact arm is provided with a movable contact, a top of the normally open stationary contact pin is provided with a normally open stationary contact in fit with the movable contact, and a bottom of the normally closed stationary contact pin is provided with a normally closed stationary contact in fit with the movable contact.

In an embodiment, a bottom of the connecting plate is provided with an auxiliary spring, one end of the auxiliary spring abuts against the connecting plate, and another end of the auxiliary spring abuts against the base body.

In an embodiment, the auxiliary spring is a tower-shaped spring, an end having a small inner diameter of the tower-shaped spring abuts against the connecting plate, and an end having a large inner diameter of the tower-shaped spring abuts against the base body.

In an embodiment, the base body is provided with a plurality of base body reverse hooks, the upper cover is provided with a plurality of upper cover buckles in fit with the base body reverse hooks, a number of the upper cover buckles corresponds to a number of the base body reverse hooks, and the positions of the upper cover buckles correspond to the positions of the base body reverse hooks.

In an embodiment, the first half of through hole for the button is internally provided with a first guide groove extending longitudinally, the second half of through hole for the button is internally provided with a second guide groove extending longitudinally, a first guide rib extending longitudinally and in fit with the first guide groove is arranged at one side of the button, and a second guide rib extending longitudinally and in fit with the second guide groove is arranged at an other side of the button.

In an embodiment, the bottom end of a button is provided with a button pressing block, one end, connected to the movable contact arm, of the connecting plate is provided with a connecting plate pressing block, and the button pressing block is in contact with the connecting plate pressing block;

one end, connected to the connecting plate, of the movable contact arm is provided with a first snap-fitting component, and the first snap-fitting component comprises a first snap-fitting block and a first snap-fitting slot; the connecting plate is provided with a second snap-fitting component in fit with the first snap-fitting component, and the second snap-fitting component comprises a second snap-fitting block and a second snap-fitting slot; the first snap-fitting block is in fit with the second snap-fitting slot, and the second snap-fitting block is in fit with the first snap-fitting slot;

a first connecting groove is arranged in a first connecting position of the movable contact arm support, and a first connecting block in fit with the first connecting groove is arranged on the connecting plate;

a second connecting groove is arranged in a second connecting position of the movable contact arm support, and a second connecting block in fit with the second connecting groove is arranged on the spring plate.

In an embodiment, the base body is provided with a first base body clamping groove, a second base body clamping groove and a third base body clamping groove; the movable contact arm support is arranged on the base body through the first base body clamping groove, the normally open stationary contact pin is arranged on the base body through the second base body clamping groove, and the normally closed stationary contact pin is arranged on the base body through the third base body clamping groove;

a magnet groove is formed between the second base body clamping groove and the third base body clamping groove, and a magnet is arranged in the magnet groove;

the connecting plate, the movable contact arm support, the normally open stationary contact pin and the normally closed stationary contact pin each are made of a copper part having a thickness of 0.8 mm; or the connecting plate, the movable contact arm support, the normally open stationary contact pin and the normally closed stationary contact pin each are made of a copper part having a thickness of 1.0 mm.

In an embodiment, the switch further comprises a handle arranged above the button;

the upper cover is provided with a first mounting table, a first mounting groove is provided on one side of the first mounting table, and the first mounting groove is internally provided with a first mounting hole; the base body is provided with a second mounting table, a second mounting groove is provided on one side of the second mounting table, and the second mounting groove is internally provided with a second mounting hole; one end of the handle is provided with a mounting head, and the mounting head is provided with a third mounting hole; and a fastener sequentially penetrates through the second mounting hole, the third mounting hole and the first mounting hole to mount the handle on the box body.

The embodiments of the present disclosure have the following technical effects:

In accordance with the dustproof high-voltage high-current micro switch provided by the present disclosure, the end, extending out of the box body formed by the base body and the upper cover, of the button is provided with the sealing sleeve, such that the button is able to be in close fit with the box body by means of the elasticity of the sealing sleeve to improve the dustproof performance of the switch. Moreover, the switch provided by the present disclosure is simple and compact in structure, low in cost, suitable for various electric tools and electric garden tools such as small electric circular saw, small angle grinders, electric sanders, electric chain saws, grass trimmers and leaf blowers which have dustproof requirements for the switch, and conforms to the Chinese safety standards.

Figure 1:
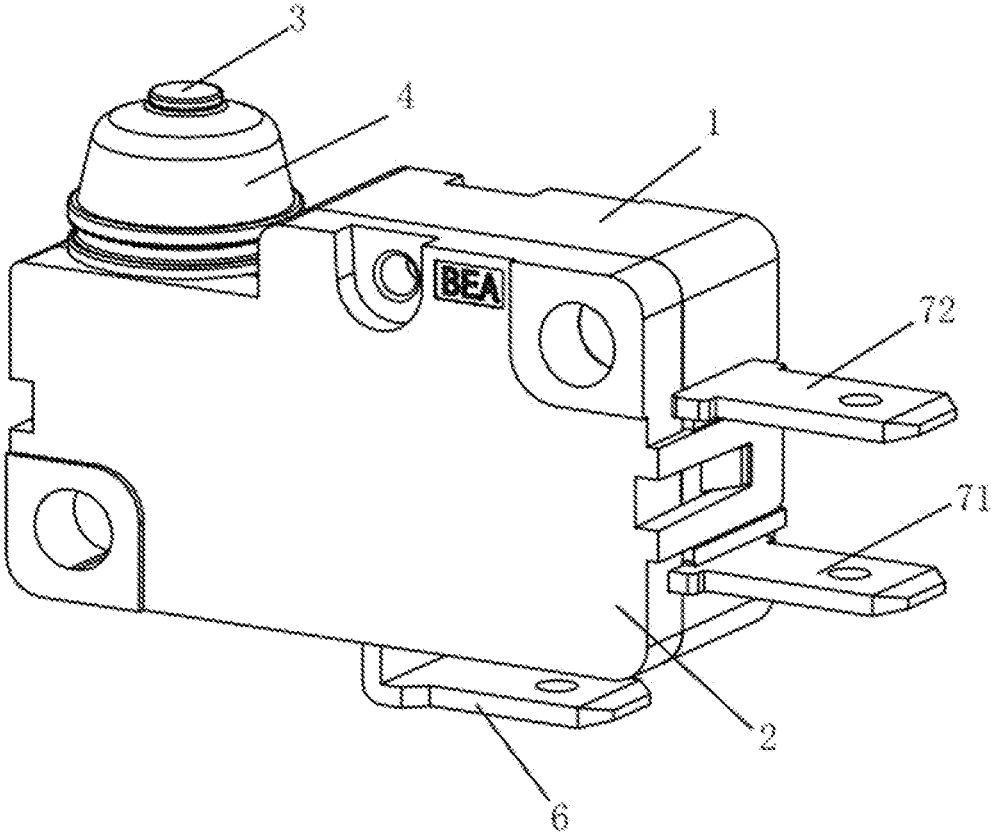
FIG. 1 is a perspective view of a dustproof micro switch in an embodiment of the present disclosure.

In the drawings: 1-base body; 2-upper cover; 3-button; 4-sealing sleeve; 5-movable contact arm assembly; 6-movable contact arm support; 7-terminal assembly; 8-auxiliary spring; 9-magnet; 10-handle; 11-fastener; 31-first button clamping groove; 32-second button clamping groove; 33-button outer edge; 34-first guide rib; 35-button pressing block; 41-button clamping block; 42-snap-fitting hole; 51-movable contact arm; 511-movable contact; 512-first snap-fitting block; 513-first snap-fitting slot; 52-connecting plate; 521-connecting plate pressing block; 522-second snap-fitting block; 523-second snap-fitting slot; 524-first connecting block; 53-spring plate; 531-second connecting block; 61-first connecting position; 611-first connecting groove; 62-second connecting position; 621-second connecting groove; 71-normally open stationary contact pin; 711-normally open stationary contact; 72-normally closed stationary contact pin; 721-normally closed stationary contact; 101-second half of through hole for the button; 1011-second button boss; 1012-second button boss outer edge; 1013-second guide groove; 102-base body reverse hook; 103-first base body clamping groove; 104-second base body clamping groove; 105-third base body clamping groove; 106-magnet groove; 107-second mounting table; 1071-second mounting groove; 1072-second mounting hole; 201-first half of through hole for the button; 2011-first button boss; 2012-first boss outer edge; 2013-first guide groove; 202-upper cover buckle; 203-first mounting table; 2031-first mounting groove; 2032-first mounting hole; 1001-mounting head; 1002-third mounting hole.

DETAILED DESCRIPTION OF THE EMBODIMENTS

The following will describe the present disclosure in detail with reference to the embodiments and accompanying drawings. It needs to be noted that the described embodiments are merely intended to facilitate an understanding of the present disclosure and are not intended to be limiting in any way.

The orientation described in the present disclosure, such as up, down, left and right, is used for the convenience of the description against the accompanying drawings and does not constitute a limitation on the scope of protection.

As shown in FIG. 1 to FIG. 6, a dustproof micro switch provided by an embodiment of the present disclosure comprises a base body 1, an upper cover 2, and a button 2, wherein the base body 1 and the upper cover 2 form a box body;

the upper cover 2 is provided with a first half of through hole for the button 201, the base body 1 is provided with a second half of through hole for the button 101, and the first half of through hole for the button 201 and the second half of through hole for the button 101 form a through hole for the button; one end of the button 3 is arranged in the box body, and the other end of the button 3 extends out of the box body through the through hole for the button;

the end, extending out of the box body, of the button 3 is provided with a sealing sleeve 4, a movable contact arm assembly 5 and a movable contact arm support 6 for fixing the movable contact arm assembly 5 are arranged below one end of the button 3 arranged in the box body, and the movable contact arm support 6 is arranged on the base body 1; and a terminal assembly 7 in fit with the movable contact arm assembly 5 is further arranged in the box body.

In accordance with the dustproof high-voltage high-current micro switch provided by the present disclosure, the end, extending out of the box body formed by the base body and the upper cover, of the button is provided with the sealing sleeve, such that the button is able to be in close fit with the box body by means of the elasticity of the sealing sleeve, thus improving the dustproof performance of the switch. Moreover, the switch provided by the present disclosure is simple and contact in structure, low in cost, suitable for various electric tools and electric garden tools such as small electric circular saw, small angle grinders, electric sanders, electric chain saws, grass trimmers and leaf blowers which have dustproof requirements for the switch, and conforms to the Chinese safety standards.

As shown in FIG. 1 to FIG. 4, the cross section of the sealing sleeve 4 is circular, and a diameter of the cross section of the end, close to the box body, of the sealing sleeve is larger than that of the cross section of the end, away from the box body, of the sealing sleeve. That is, the sealing sleeve in the embodiment is provided as a structure similar to a frustum of cone, wherein the end having the large conical surface area of the sealing sleeve is provided close to the box body, and the end having the small conical surface area of the sealing sleeve is provided away from the box body.

The upper cover 2 is provided with a first button boss 2011 at a position of the first half of through hole for the button 201, and the base body 1 is provided with a second button boss 1011 at a position of the second half of through hole for the button 101; the first button boss 2011 is provided with a first button boss outer edge 2012, and the second button boss 1011 is provided with a second button boss outer edge 1012; a first button clamping groove 31 is formed between the first button boss outer edge 2012 and the upper cover 2, a second button clamping groove 32 is formed between the second button boss outer edge 1012 and the base body 1, and the first button clamping groove 31 and the second button clamping groove 32 form a button clamping groove. Button clamping blocks 41 are arranged on the periphery of the bottom of the sealing sleeve 4, and the bottom of the sealing sleeve 4 is sleeved outside the button 3 through the fitting of the button clamping blocks 41 with the button clamping grooves.

The top of the sealing sleeve 4 is provided with a snap-fitting hole 42, the top of the button 3 is provided with a button outer edge 33, and the top of the sealing sleeve 4 is sleeved outside the button 3 through the fitting of the snap-fitting hole 42 with the button outer edge 33.

Specifically, the upper cover is provided with the first button boss at the position of the first half of through hole for the button, the base body is provided with the second button boss at the position of the second half of through hole for the button, the first button boss is provided with the first button boss outer edge, and the second button boss is provided with the second button boss outer edge, such that the first button clamping groove is formed between the first button boss outer edge and the upper cover, the second button clamping groove is formed between the second button boss outer edge and the base body, and the first button clamping groove and the second button clamping groove form the button clamping groove. The button clamping blocks are arranged on the periphery of the bottom of the sealing sleeve, such that the bottom of the sealing sleeve is sleeved outside the button through the fitting of the button clamping blocks 41 with the button clamping grooves. The top of the sealing sleeve is provided with the snap-fitting hole, the top of the button is provided with the button outer edge, and the top of the sealing sleeve is sleeved outside the button through the fitting of the snap-fitting hole with the button outer edge to completely prevent liquid or dust from entering the switch from a contact part of the switch button and the box body to affect the performance of the switch.

As shown in FIG. 3 to FIG. 6, the movable contact arm assembly 5 comprises a movable contact arm 51, a connecting plate 52 and a spring plate 53; one end of the connecting plate 52 is arranged on a first connecting position 61 of the movable contact arm support 6, the other end of the connecting plate 52 is connected to one end of the movable contact arm 51, and the other end of the movable contact arm 51 is suspended. One end of the spring plate 53 is arranged on a second connecting position 62 of the movable contact arm support 6, and the other end of the spring plate is connected to the suspended end of the movable contact arm 51.

The terminal assembly 7 comprises a normally open stationary contact pin 71 and a normally closed stationary contact pin 72 which are arranged on the base body 1, the normally open stationary contact pin 71 is arranged below the movable contact arm 51, and the normally closed stationary contact pin 72 is arranged above the movable contact arm 51.

The suspended end of the movable contact arm 51 is provided with a movable contact 511, the top of the normally open stationary contact pin 71 is provided with a normally open stationary contact 711 in fit with the movable contact 511, and the bottom of the normally closed stationary contact pin 72 is provided with a normally closed stationary contact 721 in fit with the movable contact 511.

Figure 4:
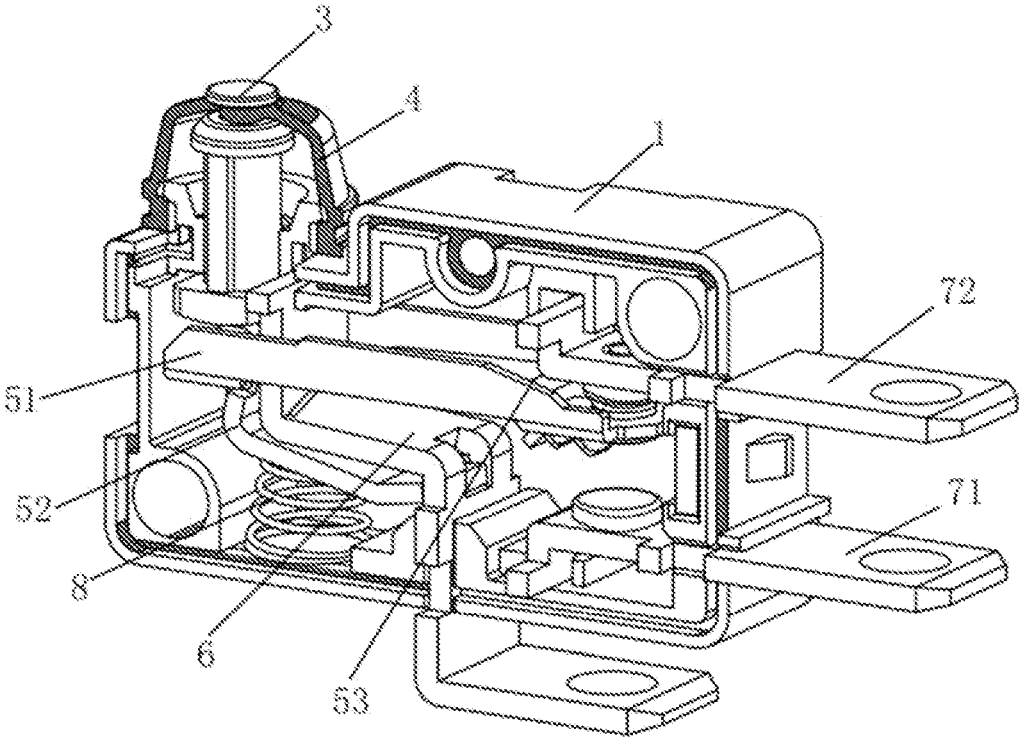
FIG. 4 is a cross-sectional view of a dustproof micro switch in an embodiment of the present disclosure.
Figure 5:
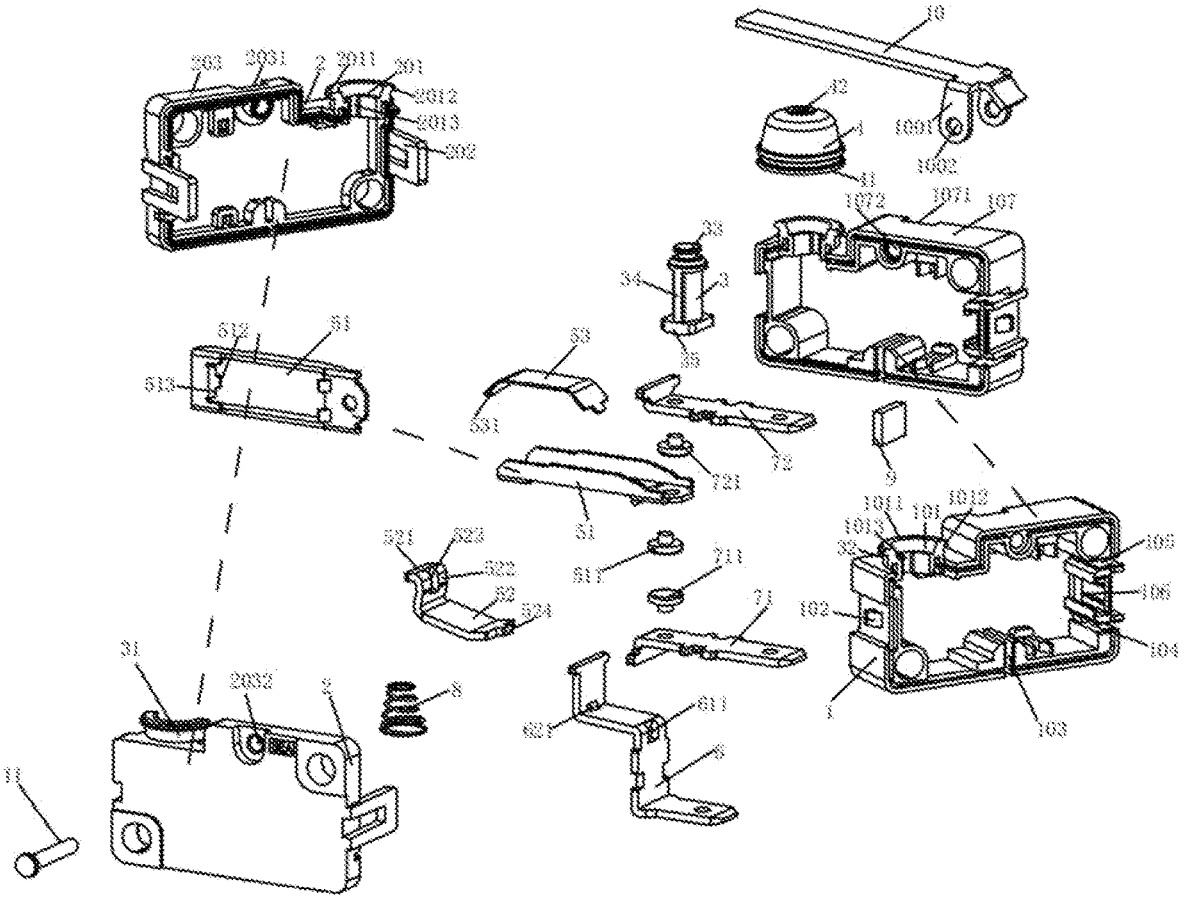
FIG. 5 is an exploded view of a dustproof micro switch in an embodiment of the present disclosure.
Figure 6:
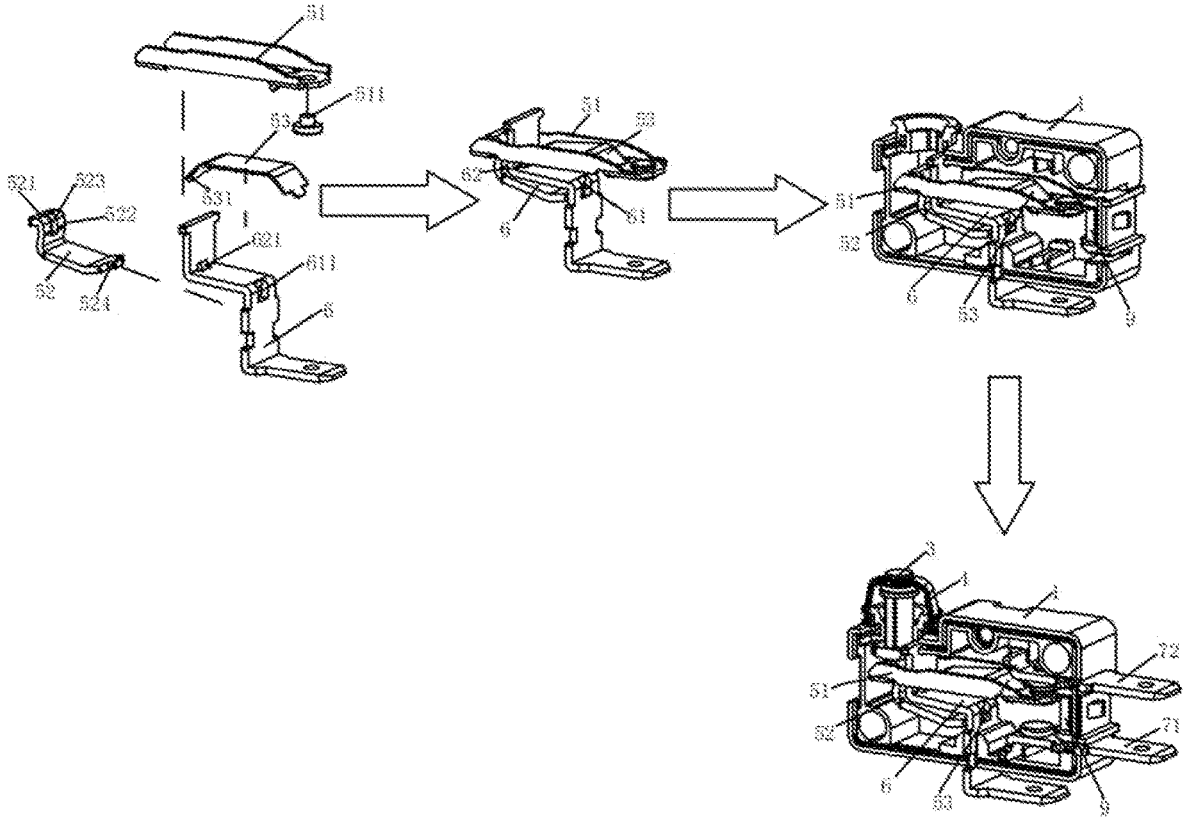
FIG. 6 is an assembly diagram of a dustproof micro switch in an embodiment of the present disclosure.

In an implementation mode, as shown in FIG. 4 and FIG. 5, the bottom of the connecting plate 52 is provided with an auxiliary spring 8, one end of the auxiliary spring 8 abuts against the connecting plate 52, and the other end of the auxiliary spring abuts against the base body 1.

In this embodiment, the bottom of the connecting plate is provided with the auxiliary spring, and one end of the auxiliary spring abuts against the connecting plate, and the other end of the auxiliary spring abuts against the base body, such that the connecting plate is reset by the auxiliary spring, thereby reducing fatigue of the spring plate and prolonging the service life of the switch.

In an embodiment, the auxiliary spring 8 is a tower-shaped spring, the end having a small inner diameter of the tower-shaped spring abuts against the connecting plate 52, and the end having a large inner diameter of the tower-shaped spring abuts against the base body 1.

In this embodiment, the auxiliary spring employs the tower-shaped spring, and the end having a small inner diameter of the tower-shaped spring abuts against the connecting plate 52, and the end having a large inner diameter of the tower-shaped spring abuts against the base body 1, thereby increasing the resetting sensitivity and precision of the switch.

As shown in FIG. 5, the base body is provided with a plurality of base body reverse hooks 102, the upper cover 2 is provided with a plurality of upper cover buckles 202 in fit with the base body reverse hooks 102, and the number and position of the upper cover buckles 202 correspond to the number and position of the base body reverse hooks 102.

In this embodiment, the upper cover is provided with the upper cover buckles, and the base body is provided with the base body reverse hooks, when the upper cover is mounted on the base body, the upper cover buckles hook onto the base body reverse hooks so as to accurately and rapidly fix the upper cover onto the base body, and the assembling process is simple.

Preferably, the surrounding grooves are provided on the base body, while the surrounding round bosses are provided on the upper cover, thus making the surrounding round bosses and the surrounding grooves form a plug-in maze type structure. Grease is applied to the surrounding grooves of the base body to achieve complete dust prevention between the base body and the upper cover.

As shown in FIG. 5, the first half of through hole for the button 201 is internally provided with a first guide groove 2013 extending longitudinally, the second half of through hole for the button 101 is internally provided with a second guide groove 1013 extending longitudinally, a first guide rib 34 extending longitudinally and in fit with the first guide groove 2013 is arranged at one side of the button 3, and a second guide rib extending longitudinally and in fit with the second guide groove 1013 is arranged at the other side of the button 3.

In this embodiment, the first half of through hole for the button is internally provided with the first guide groove extending longitudinally, the second half of through hole for the button is internally provided with the second guide groove extending longitudinally, the first guide rib extending longitudinally and in fit with the first guide groove is arranged at one side of the button, and the second guide rib extending longitudinally and in fit with the second guide groove is arranged at the other side of the button, such that the button may only move up and down than shaking left and right or front and forth in the process of pressing or loosening through the fitting of the first guide groove with the first guide rib and the fitting of the second guide groove with the second guide rib.

As shown in FIG. 5, the bottom of the button 3 is provided with a button pressing block 35, the end, connected to the movable contact arm 51, of the connecting plate 52 is provided with a connecting plate pressing block 521, and the button pressing block 35 is in contact with the connecting plate pressing block 521.

One end, connected to the connecting plate 52, of the movable contact arm 51 is provided with a first snap-fitting component, the first snap-fitting component comprises a first snap-fitting block 512 and a first snap-fitting slot 513; the connecting plate 52 is provided with a second snap-fitting component in fit with the first snap-fitting component, and the second snap-fitting component comprises a second snap-fitting block 522 and the second snap-fitting slot 523; the first snap-fitting block 512 is in fit with the second snap-fitting slot 523, and the second snap-fitting block 522 is in fit with the first snap-fitting slot 513.

A first connecting groove 611 is formed in a first connecting position 61 of the movable contact arm support 6, and a first connecting block 524 in fit with the first connecting groove 611 is arranged on the connecting plate 52.

A second connecting groove 621 is formed in a second connecting position 62 of the movable contact arm support 6, and a second connecting block 531 in fit with the second connecting groove 621 is arranged on the spring plate 53.

In this embodiment, the bottom of the button is provided with the button pressing block, the end, connected to the movable contact arm, of the connecting plate is provided with the connecting plate pressing block, and the button pressing block is in contact with the connecting plate pressing block, such that the connecting plate pressing block can be extruded by the button pressing block when pressing the button, then the connecting plate is driven to rotate downwards by taking the first connecting position on the movable contact arm support as a fulcrum, thus driving the movable contact arm to rotate downwards. When an included angle between the movable contact arm and the connecting plate is less than zero degree, the movable contact arm may jump downwards under the action of the spring plate, thus a movable silver contact on the movable contact arm is in contact with the normally open stationary contact on the normally closed stationary contact pin to achieve a turn-on function of the switch, and furthermore, the spring plate is compressed.

It needs to be noted that when the movable contact arm jumps downwards, the downward distance of the left end of the movable contact arm is limited due to the fact that the left end of the movable contact arm is held by the connecting plate and cannot move downwards, while the right end of the movable contact arm can move freely, such that the downward distance of the right side of the movable contact arm is greater than the downward distance of the left side of the movable contact arm. Therefore, the movable contact on the movable contact arm is in contact with the normally open stationary contact on the normally open stationary contact to achieve the turn-on function of the switch.

As shown in FIG. 5, the base body 1 is provided with a first base body clamping groove 103, a second base body clamping groove 104 and a third base body clamping groove 105. The movable contact arm support 6 is arranged on the base body 1 through the first base body clamping groove 103, the normally open stationary contact pin 71 is arranged on the base body 1 through the second base body clamping groove 104, and the normally closed stationary contact pin 72 is arranged on the base body 1 through the third base body clamping groove 105.

A magnet groove 106 is formed between the second base body clamping groove 104 and the third base body clamping groove 105, and a magnet 9 is arranged in the magnet groove 106.

In this embodiment, when the switch is applied to a high-voltage DC tool, the magnet groove can be formed between the second base body clamping groove and the third base body clamping groove on the base body, and the magnet can be arranged in the magnet groove to absorb electric arc generated in the turn-on and turn-off process of the switch, thereby preventing the contact from being easily ablated and then prolonging the service life of the switch.

Preferably, the connecting plate 52, the movable contact arm support 6, the normally open stationary contact pin 71 and the normally closed stationary contact pin 72 each is made of a copper part having a thickness of 0.8 mm; or the connecting plate 52, the movable contact arm support 6, the normally open stationary contact pin 71 and the normally closed stationary contact pin 72 each is made of a copper part having a thickness of 1 mm.

In this embodiment, when the switch is applied to a general-current electric tool or electric garden tool, the copper part having the thickness of 0.8 mm can be used for manufacturing the connecting plate, the movable contact arm support, the normally open stationary contact pin and the normally closed stationary contact pin. When the switch is applied to a high-current DC electric tool, for example, the current I is more than or equal to 25A, the copper part having the thickness of 1.0 mm can be used for manufacturing the connecting plate, the movable contact arm support, the normally open stationary contact pin and the normally closed stationary contact pin.

Figure 2:
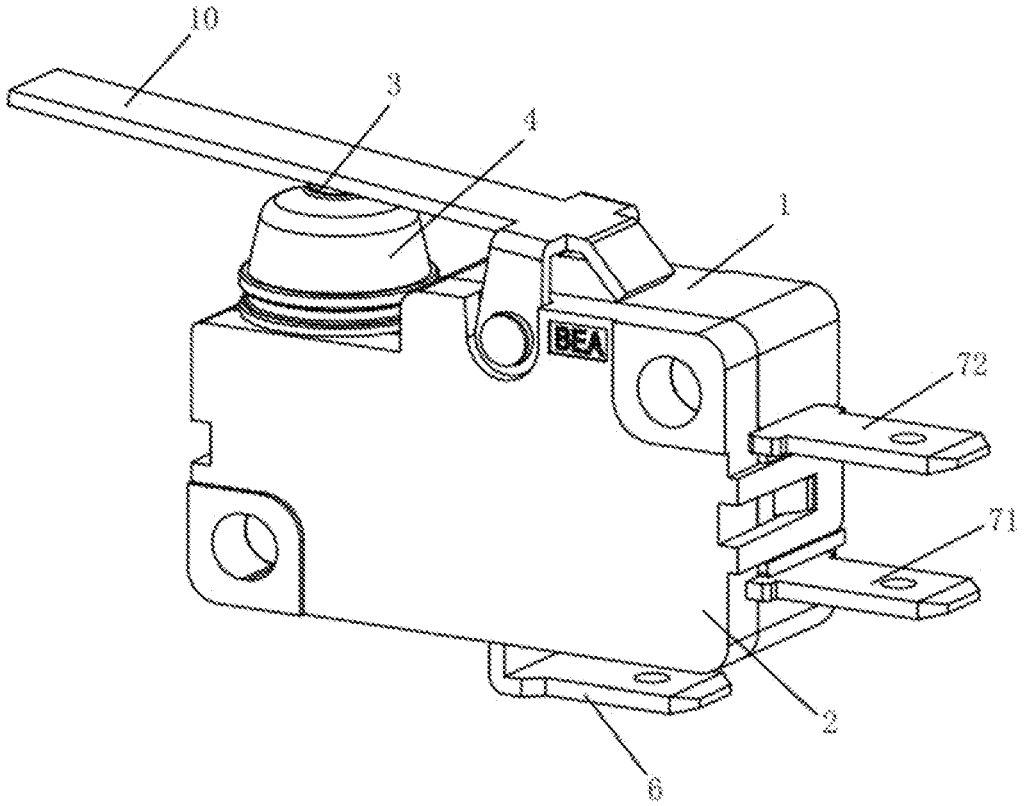
FIG. 2 is a perspective view of a dustproof micro switch in an embodiment of the present disclosure.
Figure 3:
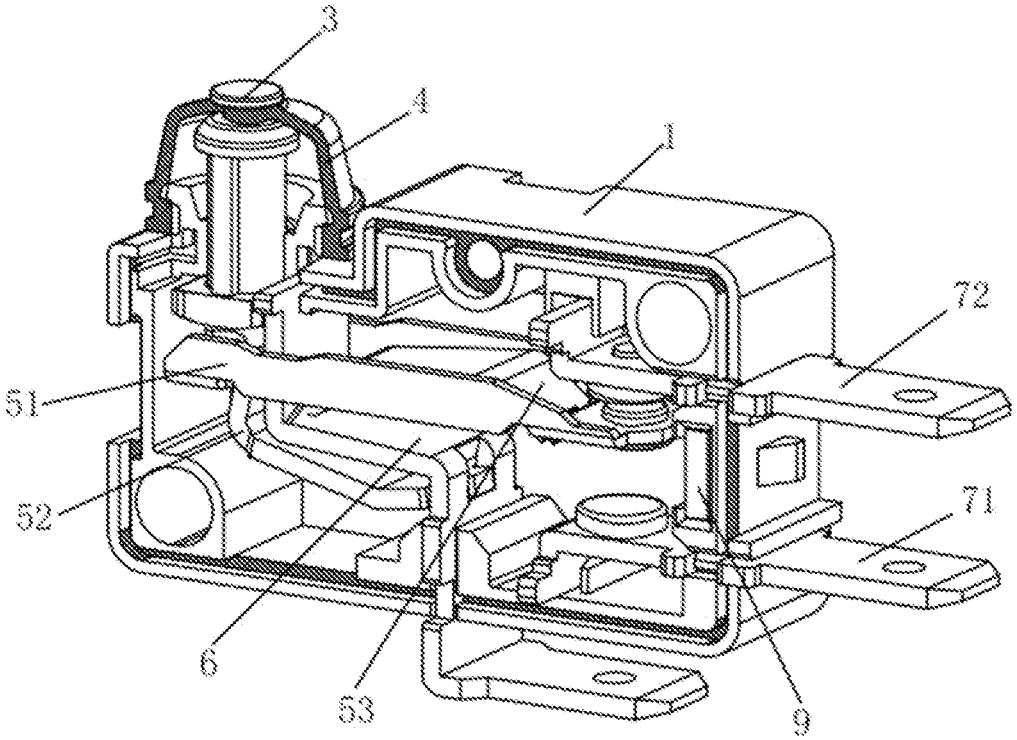
FIG. 3 is a cross-sectional view of a dustproof micro switch in an embodiment of the present disclosure.

In an implementation mode, as shown in FIG. 2 and FIG. 5, the switch further comprises a handle 10 arranged above the button 3.

The upper cover 2 is provided with a first mounting table 203, a first mounting groove 2031 is provided on one side of the first mounting table 203, and the first mounting groove 2031 is internally provided with a first mounting hole 2032; the base body is provided with a second mounting table 107, a second mounting groove 1071 is provided on one side of the second mounting table 107, and the second mounting groove 1071 is provided with a second mounting hole 1072; one end of the handle 10 is provided with a mounting head 1001, the mounting head 1001 is internally provided with a third mounting hole 1002; and a fastener 11 penetrates through the second mounting hole 1072, the third mounting hole 1002 and the first mounting hole 2032 in sequence to mount the handle 10 on the box body.

In this embodiment, the handle is mounted on the upper cover and mounted above the button, such that the button can be rapidly and conveniently operated by means of the handle, thus the time cost is saved.

It needs to be noted that the specific structure of the handle is not limited by the embodiment of the present disclosure.

It needs to be further noted that two ends of the top of the upper cover in the embodiment of the present disclosure can both be provided with the first mounting tables 203, such that the handle can be movably connected to any end of the top of the upper cover as required.

A working process of the dustproof micro switch provided by the present disclosure is described below:

when the button 3 is pressed, the button 3 drives the connecting plate 52 to rotate downwards by taking the first connecting position on the movable contact arm support 6 as the fulcrum, thus driving the movable contact arm 51 to rotate downwards; when the included angle between the movable contact arm 51 and the connecting plate 52 is less than zero degree, the movable contact arm 51 may jump downwards under the action of the spring plate 53 to make the movable silver contact 511 on the movable contact arm 51 in contact with the normally open stationary contact 711 on the normally open stationary contact pin 71, thus achieving the turn-on function of the switch; and furthermore, the spring plate 53 is compressed. The principle thereof is that: when the movable contact arm 51 jumps downwards, as the end, connected to the connecting plate, of the movable contact arm 51 is provided with two first snap-fitting blocks 512, in the downward movement process of the movable contact arm 51, the downward distance of the left end of the movable contact arm 51 is limited due to the fact that the left end of the movable contact arm 51 is held by the connecting plate 51 and cannot move downwards, while the right end of the movable contact arm 51 can move freely, such that the downward distance of the right side of the movable contact arm 51 is greater than the downward distance of the left side of the movable contact arm 51. Therefore, the movable contact 511 on the movable contact arm 51 is in contact with the normally open stationary contact 711 on the normally open stationary contact pin 71 to achieve the turn-on function of the switch, and furthermore, the spring plate 53 is compressed.

When the button 3 is released, the spring plate 53 is reset, the movable contact arm 51 may jump upwards under the action of the spring plate 53 to make the movable contact 511 on the movable contact arm 51 in contact with the normally closed stationary contact 721 on the normally closed stationary contact pin 72, thus achieving a normally closed brake function of the switch.

Finally, it should be noted that the above embodiments are only used to illustrate the technical solutions of the present disclosure rather than limiting the same. Although the present disclosure has been described in detail with reference to the foregoing embodiments, it should be understood by those of ordinary skill in the art that it is still possible to modify or equivalently replace the technical solutions of the present disclosure without departing from the essence and scope of the technical solutions of the present disclosure.

What is claimed is:

1. A dustproof micro switch, comprising a base body, an upper cover, and a button, wherein the base body and the upper cover form a box body;

the upper cover is provided with a first half of through hole for the button, the base body is provided with a second half of through hole for the button, and the first half of through hole for the button and the second half of through hole for the button form a through hole for the button; one end of the button is arranged in the box body, and another end of the button extends out of the box body through the through hole for the button;

the end, extending out of the box body, of the button is provided with a sealing sleeve, a movable contact arm assembly and a movable contact arm support for fixing the movable contact arm assembly are arranged below the end of the button arranged in the box body, and the movable contact arm support is arranged on the base body; and a terminal assembly in fit with the movable contact arm assembly is further arranged in the box body;

wherein a cross section of the sealing sleeve is circular, and a diameter of the cross section of an end, close to the box body, of the sealing sleeve is larger than that of the cross section of an end, away from the box body, of the sealing sleeve;

the upper cover is provided with a first button boss at a position of the first half of through hole for the button, and the base body is provided with a second button boss at a position of the second half of through hole for the button; the first button boss is provided with a first button boss outer edge, and the second button boss is provided with a second button boss outer edge; a first button clamping groove is formed between the first button boss outer edge and the upper cover, a second button clamping groove is formed between the second button boss outer edge and the base body, and the first button clamping groove and the second button clamping groove form a button clamping groove; a button clamping block is arranged on a periphery of a bottom of the sealing sleeve, and the bottom of the sealing sleeve is sleeved outside the button through the fitting of the button clamping block with the button clamping groove;

a top of the sealing sleeve is provided with a snap-fitting hole, a top of the button is provided with a button outer edge, and the top of the sealing sleeve is sleeved outside the button through the fitting of the snap-fitting hole with the button outer edge.

2. The dustproof micro switch according to claim 1, wherein the movable contact arm assembly comprises a movable contact arm, a connecting plate and a spring plate; one end of the connecting plate is arranged on a first connecting position of the movable contact arm support, another end of the connecting plate is connected to one end of the movable contact arm, and another end of the movable contact arm is suspended; one end of the spring plate is arranged on a second connecting position of the movable contact arm support, and another end of the spring plate is connected to the suspended end of the movable contact arm;

the terminal assembly comprises a normally open stationary contact pin and a normally closed stationary contact pin which are arranged on the base body, the normally open stationary contact pin is arranged below the movable contact arm, and the normally closed stationary contact pin is arranged above the movable contact arm;

the suspended end of the movable contact arm is provided with a movable contact, a top of the normally open stationary contact pin is provided with a normally open stationary contact in fit with the movable contact, and a bottom of the normally closed stationary contact pin is provided with a normally closed stationary contact in fit with the movable contact.

3. The dustproof micro switch according to claim 2, wherein a bottom of the connecting plate is provided with an auxiliary spring, one end of the auxiliary spring abuts against the connecting plate, and another end of the auxiliary spring abuts against the base body.

4. The dustproof micro switch according to claim 3, wherein the auxiliary spring is a tower-shaped spring, an end having a small inner diameter of the tower-shaped spring abuts against the connecting plate, and an end having a large inner diameter of the tower-shaped spring abuts against the base body.

5. The dustproof micro switch according to claim 1, wherein the base body is provided with a plurality of base body reverse hooks, the upper cover is provided with a plurality of upper cover buckles in fit with the base body reverse hooks, a number of the upper cover buckles corresponds to a number of the base body reverse hooks, and positions of the upper cover buckles correspond to positions of the base body reverse hooks.

6. The dustproof micro switch according to claim 1, wherein the first half of through hole for the button is internally provided with a first guide groove extending longitudinally, the second half of through hole for the button is internally provided with a second guide groove extending longitudinally, a first guide rib extending longitudinally and in fit with the first guide groove is arranged at one side of the button, and a second guide rib extending longitudinally and in fit with the second guide groove is arranged at an other side of the button.

7. The dustproof micro switch according to claim 2, wherein a bottom of the button is provided with a button pressing block, an end, connected to the movable contact arm, of the connecting plate is provided with a connecting plate pressing block, and the button pressing block is in contact with the connecting plate pressing block;

an end, connected to the connecting plate, of the movable contact arm is provided with a first snap-fitting component, and the first snap-fitting component comprises a first snap-fitting block and a first snap-fitting slot; the connecting plate is provided with a second snap-fitting component in fit with the first snap-fitting component, and the second snap-fitting component comprises a second snap-fitting block and a second snap-fitting slot; the first snap-fitting block is in fit with the second snap-fitting slot, and the second snap-fitting block is in fit with the first snap-fitting slot;

a first connecting groove is arranged in a first connecting position of the movable contact arm support, and a first connecting block in fit with the first connecting groove is arranged on the connecting plate;

a second connecting groove is arranged in a second connecting position of the movable contact arm support, and a second connecting block in fit with the second connecting groove is arranged on the spring plate.

8. The dustproof micro switch according to claim 2, wherein the base body is provided with a first base body clamping groove, a second base body clamping groove and a third base body clamping groove; the movable contact arm support is arranged on the base body through the first base body clamping groove, the normally open stationary contact pin is arranged on the base body through the second base body clamping groove, and the normally closed stationary contact pin is arranged on the base body through the third base body clamping groove;

a magnet groove is formed between the second base body clamping groove and the third base body clamping groove, and a magnet is arranged in the magnet groove;

the connecting plate, the movable contact arm support, the normally open stationary contact pin and the normally closed stationary contact pin each are made of a copper part having a thickness of 0.8 mm; or the connecting plate, the movable contact arm support, the normally open stationary contact pin and the normally closed stationary contact pin each are made of a copper part having a thickness of 1.0 mm.

9. The dustproof micro switch according to claim 1, wherein the switch further comprises a handle arranged above the button;

the upper cover is provided with a first mounting table, a first mounting groove is provided on one side of the first mounting table, and the first mounting groove is internally provided with a first mounting hole; the base body is provided with a second mounting table, a second mounting groove is provided on one side of the second mounting table, and the second mounting groove is internally provided with a second mounting hole; one end of the handle is provided with a mounting head, and the mounting head is provided with a third mounting hole; and a fastener sequentially penetrates through the second mounting hole, the third mounting hole and the first mounting hole to mount the handle on the box body.

10. The dustproof micro switch according to claim 1, wherein the movable contact arm assembly comprises a movable contact arm, a connecting plate and a spring plate; one end of the connecting plate is arranged on a first connecting position of the movable contact arm support, another end of the connecting plate is connected to one end of the movable contact arm, and another end of the movable contact arm is suspended; one end of the spring plate is arranged on a second connecting position of the movable contact arm support, and another end of the spring plate is connected to the suspended end of the movable contact arm;

the terminal assembly comprises a normally open stationary contact pin and a normally closed stationary contact pin which are arranged on the base body, the normally open stationary contact pin is arranged below the movable contact arm, and the normally closed stationary contact pin is arranged above the movable contact arm;

the suspended end of the movable contact arm is provided with a movable contact, a top of the normally open stationary contact pin is provided with a normally open stationary contact in fit with the movable contact, and a bottom of the normally closed stationary contact pin is provided with a normally closed stationary contact in fit with the movable contact.

11. The dustproof micro switch according to claim 10, wherein a bottom of the connecting plate is provided with an auxiliary spring, one end of the auxiliary spring abuts against the connecting plate, and another end of the auxiliary spring abuts against the base body.

12. The dustproof micro switch according to claim 11, wherein the auxiliary spring is a tower-shaped spring, an end having a small inner diameter of the tower-shaped spring abuts against the connecting plate, and an end having a large inner diameter of the tower-shaped spring abuts against the base body.

13. The dustproof micro switch according to claim 1, wherein the base body is provided with a plurality of base body reverse hooks, the upper cover is provided with a plurality of upper cover buckles in fit with the base body reverse hooks, a number of the upper cover buckles corresponds to a number of the base body reverse hooks, and positions of the upper cover buckles correspond to positions of the base body reverse hooks.

14. The dustproof micro switch according to claim 10, wherein a bottom of the button is provided with a button pressing block, an end, connected to the movable contact arm, of the connecting plate is provided with a connecting plate pressing block, and the button pressing block is in contact with the connecting plate pressing block;

an end, connected to the connecting plate, of the movable contact arm is provided with a first snap-fitting component, and the first snap-fitting component comprises a first snap-fitting block and a first snap-fitting slot; the connecting plate is provided with a second snap-fitting component in fit with the first snap-fitting component, and the second snap-fitting component comprises a second snap-fitting block and a second snap-fitting slot; the first snap-fitting block is in fit with the second snap-fitting slot, and the second snap-fitting block is in fit with the first snap-fitting slot;

a first connecting groove is arranged in a first connecting position of the movable contact arm support, and a first connecting block in fit with the first connecting groove is arranged on the connecting plate;

a second connecting groove is arranged in a second connecting position of the movable contact arm support, and a second connecting block in fit with the second connecting groove is arranged on the spring plate.

15. The dustproof micro switch according to claim 10, wherein the base body is provided with a first base body clamping groove, a second base body clamping groove and a third base body clamping groove; the movable contact arm support is arranged on the base body through the first base body clamping groove, the normally open stationary contact pin is arranged on the base body through the second base body clamping groove, and the normally closed stationary contact pin is arranged on the base body through the third base body clamping groove;

a magnet groove is formed between the second base body clamping groove and the third base body clamping groove, and a magnet is arranged in the magnet groove;

the connecting plate, the movable contact arm support, the normally open stationary contact pin and the normally closed stationary contact pin each are made of a copper part having a thickness of 0.8 mm; or the connecting plate, the movable contact arm support, the normally open stationary contact pin and the normally closed stationary contact pin each are made of a copper part having a thickness of 1.0 mm.

16. The dustproof micro switch according to claim 7, wherein the base body is provided with a first base body clamping groove, a second base body clamping groove and a third base body clamping groove; the movable contact arm support is arranged on the base body through the first base body clamping groove, the normally open stationary contact pin is arranged on the base body through the second base body clamping groove, and the normally closed stationary contact pin is arranged on the base body through the third base body clamping groove;

a magnet groove is formed between the second base body clamping groove and the third base body clamping groove, and a magnet is arranged in the magnet groove;

the connecting plate, the movable contact arm support, the normally open stationary contact pin and the normally closed stationary contact pin each are made of a copper part having a thickness of 0.8 mm; or the connecting plate, the movable contact arm support, the normally open stationary contact pin and the normally closed stationary contact pin each are made of a copper part having a thickness of 1.0 mm.

17. The dustproof micro switch according to claim 14, wherein the base body is provided with a first base body clamping groove, a second base body clamping groove and a third base body clamping groove; the movable contact arm support is arranged on the base body through the first base body clamping groove, the normally open stationary contact pin is arranged on the base body through the second base body clamping groove, and the normally closed stationary contact pin is arranged on the base body through the third base body clamping groove;

a magnet groove is formed between the second base body clamping groove and the third base body clamping groove, and a magnet is arranged in the magnet groove;

the connecting plate, the movable contact arm support, the normally open stationary contact pin and the normally closed stationary contact pin each are made of a copper part having a thickness of 0.8 mm; or the connecting plate, the movable contact arm support, the normally open stationary contact pin and the normally closed stationary contact pin each are made of a copper part having a thickness of 1.0 mm.

18. The dustproof micro switch according to claim 1, wherein the switch further comprises a handle arranged above the button;

the upper cover is provided with a first mounting table, a first mounting groove is provided on one side of the first mounting table, and the first mounting groove is internally provided with a first mounting hole; the base body is provided with a second mounting table, a second mounting groove is provided on one side of the second mounting table, and the second mounting groove is internally provided with a second mounting hole; one end of the handle is provided with a mounting head, and the mounting head is provided with a third mounting hole; and a fastener sequentially penetrates through the second mounting hole, the third mounting hole and the first mounting hole to mount the handle on the box body.

* * * * *